United States Patent [19]

Wolfe

[11] Patent Number: 4,597,574

[45] Date of Patent: Jul. 1, 1986

[54] TOY APPARATUS SIMULATING HUNTING OR COMBAT

[76] Inventor: Henry S. Wolfe, P.O. Box 6025, Clearwater, Fla. 33518

[21] Appl. No.: 731,577

[22] Filed: May 7, 1985

[51] Int. Cl.[4] ..... A63F 9/00

[52] U.S. Cl. ..... 273/85 F; 273/1 F; 273/403; 273/408; 446/334; 446/368; 446/385

[58] Field of Search ..... 273/1 R, 1 G, 1 F, 403, 273/404, 408, 85 R, 85 F; 446/97, 334, 335, 336, 368, 385; 47/41.12, 41.1; 215/227; 220/307

[56] References Cited

U.S. PATENT DOCUMENTS

| | | | |
|---|---|---|---|
| 1,227,249 | 5/1917 | Davey | 273/405 X |
| 1,453,396 | 5/1923 | Leggatt | 273/408 |
| 2,307,286 | 1/1943 | Matignon | 47/41.12 |
| 2,601,658 | 6/1952 | Bussert | 47/41.12 |
| 3,048,401 | 8/1962 | Dishon | 273/407 |
| 3,080,088 | 3/1963 | Corrinet | 220/307 X |
| 3,148,480 | 9/1964 | Gallo | 47/41.12 |
| 3,163,418 | 12/1964 | Myers | 273/408 |
| 3,368,303 | 2/1968 | Tong | 47/41.12 |
| 3,374,921 | 3/1968 | Kelley | 220/307 |
| 3,547,436 | 12/1960 | Breslow | 273/1 GG |
| 3,576,323 | 4/1971 | Pellicer | 273/1 F |
| 3,578,320 | 5/1971 | Goldfarb | 273/1 GG |
| 3,724,848 | 4/1973 | Glass et al. | 273/1 GG |
| 4,054,288 | 10/1977 | Perrine, Sr. | 273/408 X |
| 4,082,280 | 4/1978 | Lang | 273/408 |
| 4,169,336 | 10/1979 | Kuhn | 46/156 |
| 4,203,600 | 5/1980 | Brown | 273/407 |
| 4,477,082 | 10/1984 | McKenzie et al. | 273/403 |

FOREIGN PATENT DOCUMENTS

| | | | |
|---|---|---|---|
| 364552 | 8/1920 | Fed. Rep. of Germany | 215/227 |

OTHER PUBLICATIONS

Montgomery Ward Christmas Values '83 catalog 9-1983, p. 104, Lego Medieval Castle Set.

*Primary Examiner*—Paul E. Shapiro
*Attorney, Agent, or Firm*—Irvin A. Lavine

[57] ABSTRACT

Toy apparatus for simulating hunting or battle comprises one or more target figures, such as an animal. The target figure is made of relatively hard material and is provided with at least one cavity extending to the surface of the figure, preferably located where on the animal simulated there is no protective bone or plate structure, such as the abdomen, neck, etc. A soft clay-like or putty-like substance is in the cavity. A weapon such as a toy spear, sword, etc. upon striking the soft material, will penetrate into and remain in it until withdrawn. A human-like hunter figure may also be provided, releasably carrying a spear or other penetrating weapon. Other figures may be provided, of various existing, non-existing, and fanciful animal or other targets, and corresponding hunter figures; there may be provided plural human or human-like figures, with both soft substance-filled cavities and a penetrating simulated weapon.

24 Claims, 10 Drawing Figures

TOY APPARATUS SIMULATING HUNTING OR COMBAT

BACKGROUND OF THE INVENTION

The present invention is related to toy apparatus, and more particularly to small figures simulating hunting, for survival or sport, or war-like conflicts.

Various toys have been produced, simulating animal or creature figures which exist, which are extinct, or which are fanciful. In general, these have been provided for viewing and/or for handling. In addition, there have been provided human or human-like figures in various forms and dresses, including toy soldier figures, fanciful inhabitants of outer space and existing, extinct, or fanciful human-like figures. Many of these have principally been provided for maneuvering as "adversaries in battle."

In addition, various targets have been provided in connection with target practice, such as archery targets, some of these targets simulating natural animals. Among these are U.S. Patents to Myers, No. 3,163,418; McKenzie et al., No. 4,477,082; Lang, No. 4,082,280; and Perrine, Sr., No. 4,054,288. In general, these prior art archery or similar targets have either been homogeneous in their makeup, or have included replaceable parts or sections at the portions of the simulated target figures which are most likely to be struck by the arrows of the archer. In particular, McKensie et al., 4,477,082, provides an archery target simulating a deer comprising front and rear sections and an intermediate target segment, the various parts of the target being made of foam plastic and the central or intermediate segment or portion being of foam plastic of higher density, and therefore being less penetrable than the other sections.

SUMMARY OF THE INVENTION

There is provided herein apparatus for simulating a prehistoric hunter trying to slay an animal for food, or conversely, an animal attacking a prehistoric hunter, and comprising a toy target figure having one or more cavities extending partly or completely through it, and the cavities being located at portions which on the animal simulated would be considered vulnerable, being unprotected by bone, scale or plates. In the cavities there is provided a clay-like substance which is relatively soft in contrast to the body, which is made of a relatively hard material, such as plastic or die-cast metals or other materials that retain their shape when handled. The clay-like substance is capable of being penetrated by a simulated weapon, such as a toy spear. The clay-like mass in the cavities will receive and retain a simulated spear unless forcefully withdrawn. The hard plastic form of the simulated animal figure and the cavities within serve to support and retain the shape of the softer clay-like substance which otherwise would deform under handling while in use. The clay-like mass can be struck repeatedly with a simulated weapon without deforming as a whole, other than the penetration holes, to serve the purpose of indicating representative injury to vital parts of a simulated animal-like figure.

There is also provided a toy figure simulating a hunter, the hunter preferably carrying a releasable simulated spear. In this manner, the hunter figure may be maneuvered and manipulated so that the spear may be caused to enter into the clay-like mass in the cavities of the animal figure, and when the hunter figure is withdrawn, the spear remains stuck into the animal, indicating penetration of the animal's vulnerable body area. The hunter's simulated spear can only enter the cavities containing the soft clay-like mass as the harder plastic parts of the animal cannot be penetrated by the spear.

Also provided by the present invention are a plurality of human or human-like combatants, each having at least one cavity with clay-like material therein, and each being provided with a releasably-held simulated penetrating weapon; there may be provided, also, simulated shields on these toy figures which partly protect at least one cavity region against penetration by the simulated penetrating weapon of an opposing combatant.

An object of the present invention is to provide toy figures simulating the result of hunting or combat between two or more participants.

Another object is to provide toy figures which are capable of simulating the wounding or damaging of a creature or object.

Still another object of the present invention is the provision of toy figures which dramatize injury to a living creature inflicted by a weapon, particularly a penetrating weapon, such as a spear, sword, fang, claw, etc.

Still another object of the present invention is the provision of a toy apparatus which provides for game playing simulating hunting or combat, utilizing figures which may reveal wounding or damage, and which are realistic or fanciful.

Still another object of the present invention is the provision of toy figures that contain a material in at least one exposed cavity which is penetrable by simulated penetrating weapon.

Still another object of the present invention is to provide toy figures that dramatize wound or damage to a creature or object, and which make such wound or damage apparent.

Still another object of the present invention is to provide a toy which readily permits restoration of the toy to the uninjured or undamaged configuration, to provide such a toy that retains weapons released by an adversary figure, to provide a toy figure with penetrable material located at vulnerable parts of a simulated or imagined creature or object, and to provide a toy which securely holds penetrable material, and which permits replacement thereof in whole or in part.

Other objects and many of the attendant advantages of the present invention will be readily understood under consideration of the following description, claims and drawings.

DESCRIPTION OF THE PREFERRED EMBODIMENTS

Figure 1:
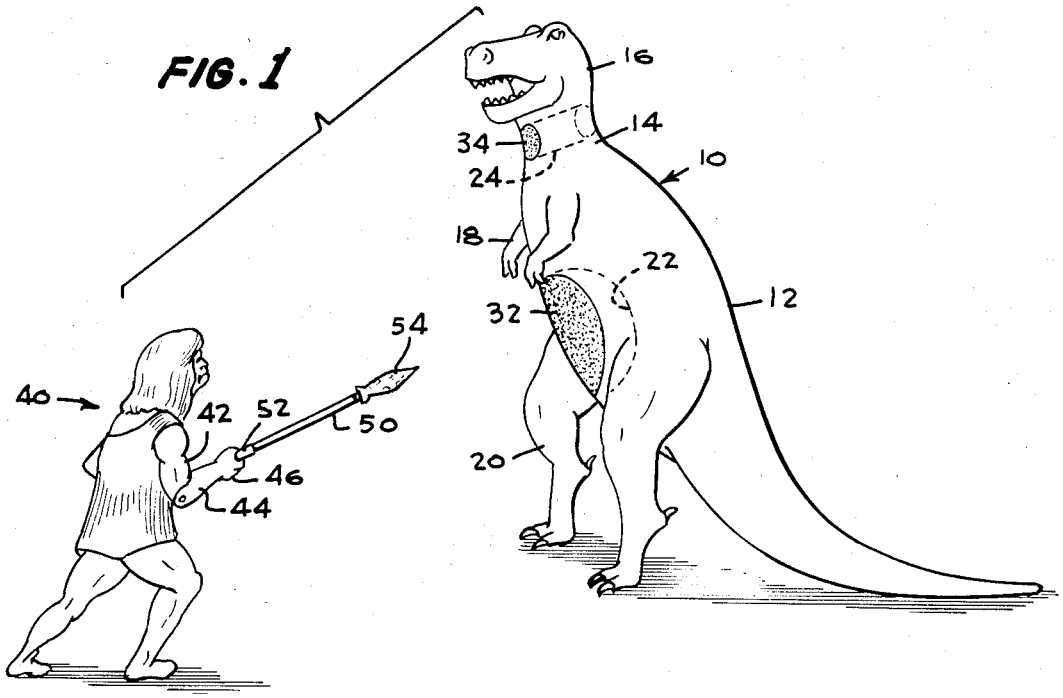
FIG. 1 is a perspective view of an amusement device in accordance with the present invention, and including a first figure simulating a hunted animal, and a second figure simulating a hunter.

Referring now to the drawings, wherein like or corresponding reference numerals are used for like or corresponding parts throughout the several views, there is shown in FIG. 1 a target figure generally designated 10. The target figure 10 simulates a prehistoric animal, specifically a dinosaur, and in general has the physical characteristics and appearance of a dinosaur as now understood. The target figure 10 includes a body 12 having a neck 14 connecting it with a head 16. The body 12 is also provided with upper legs 18 and lower legs 20. The body 12 is made of a relatively hard material, such as a hard plastic material, and may be colored to simulate the true colors of the animal which the target figure is intended to simulate or represent.

It is understood and assumed for purposes of the present disclosure that the actual dinosaur represented by the figure 10 had a hard covering and/or bones over much of its body and therefore the animal, for the most part, was protected against injury due to penetration of weapons, such as spears, which may have been carried by human-like ancestors of the present human species. Such protective covering and bone structure to some extent also protected the animals against their natural enemies. Those animals, however, had certain portions of their body which were less protected, and which may be thought of as being vulnerable to the weapons of other animals or creatures.

In accordance with the present invention, the target figure 10 is provided with a cavity 22 in the region of the stomach, cavity 22 being provided by a depression or hollow which extends only part way through body 12, from the normal exterior surface thereof, and which is located at a region of the body which was a vulnerable region in the animal which is simulated; in this case the cavity 22 is at the stomach or abdomen region, which was or is assumed to have been a vulnerable region in the dinosaur represented by the target figure 10.

Another cavity 24 is located in the neck 14 of the target figure 10, and comprises a passage which extends completely through the neck 14 of the target figure 10. As will be understood, the neck 14 is also a vulnerable region of the animal represented, being unprotected or only partly protected by plates or scales which would resist penetration by horns, fangs, teeth, claws, and human-like weapons.

In the cavity depression 22 and in the cavity passage 24, there are provided a mass 32 and a mass 34, respectively, of clay-like material. The clay-like material is positioned and shaped so as to complete the simulated shape, and thereby provide a realistic appearance to the target figure 10. In addition, the clay-like material 32, 34 may be appropriately colored to give the most natural appearance as understood from present-day knowledge. The clay-like material has the property of being a pasty, semi-solid, relatively soft material, that is soft in comparison to the material from which the body 12 is formed. While the body 12 is impenetrable to simulated toy spears and the like, penetrating weapons, and the forces thereon likely to be applied by children, the clay-like material is readily penetrable by such a toy spear or similar missile or weapon, as handled and manipulated by a child, and is capable of retaining a simulated or toy weapon, to simulate the results of actual hunting or combat.

The clay-like material is manually mouldable by children, and does not deteriorate to any significant extent when penetrated. A toy weapon may be repeatedly stuck into and removed from the clay-like material, without significant damage. Further, the clay-like material may be readily restored to undamaged condition if it becomes misshapen or displaced by toy spears or other weapons, by a simple manual manipulation or molding. Further, should some or all of the clay-like material be lost or removed from the cavities during play or otherwise, the part or the entirety of the mass of clay-like material may be readily replaced and molded and/or melded into any existing or remaining portion of the mass. Thus, by the provision of a new clay-like mass, renewal of the mass may be effected; also, a part of the required mass may be added to an existing or remaining part, and manipulated to form a homogeneous mass, thereby restoring the mass to its original appearance and condition.

Materials which are suitable for the clay-like mass include: clay, modeling clay, the commercially available material sold under the trademark "Silly Putty", the material sold under the trademark "Play Dough" and disclosed in McVicker et al., U.S. Pat. No. 3,167,440, and various other plastic material having the same or similar properties.

Whatever the material of which the clay-like mass is made, it will be understood that it may be readily penetrated by a toy spear or similar weapon when thrust or manipulated by a child, and retain the toy weapon, simulating thereby actual hunting or combat occurrences.

The target figure 10 is illustrated in the drawings as being an actual or fancied dinosaur. Thus, it has the form of an extinct animal. As will be understood, there may be provided a representation not only of an entire animal, but of a part of an animal. The target figure may be of a prehistoric animal, as illustrated here, or an animal which is extinct, such as the kiwi bird, or an existing animal, such as elephants, tigers, etc. The target figure can and may be of a fanciful animal, such as may be found in heraldry, or may be a more modern form of a fanciful animal, such as a space monster. Not only animals may be represented, but other life-forms, including fish, reptiles, insects, and birds. The target figure may be of other forms, such as human or human-like creatures, and may be a non-life form, such as a plane, ship, vehicle, etc.

Referring again to FIG. 1, there is also shown a hunter figure 40, here represented as a human-like creature. The hunter figure 40 is preferably partly or fully-scaled in relationship to the target figure 10. The hunter figure 40 will be seen to have an arm 42, forearm 44, and hand 46, hand 46 having an opening 48 (see FIG. 2) therein, and there being provided pivotal connections or other means for providing articulation of the parts of the simulated body of the hunter figure 40. Alternatively, the arm may be fixed.

A simulated weapon, specifically spear 50, is carried by the hunter figure 40 and is provided with an enlargement 52 which is larger than the opening 48 in the hand 46 of hunter figure 40. At its forward end the spear 50 has a point 54.

Figure 2:
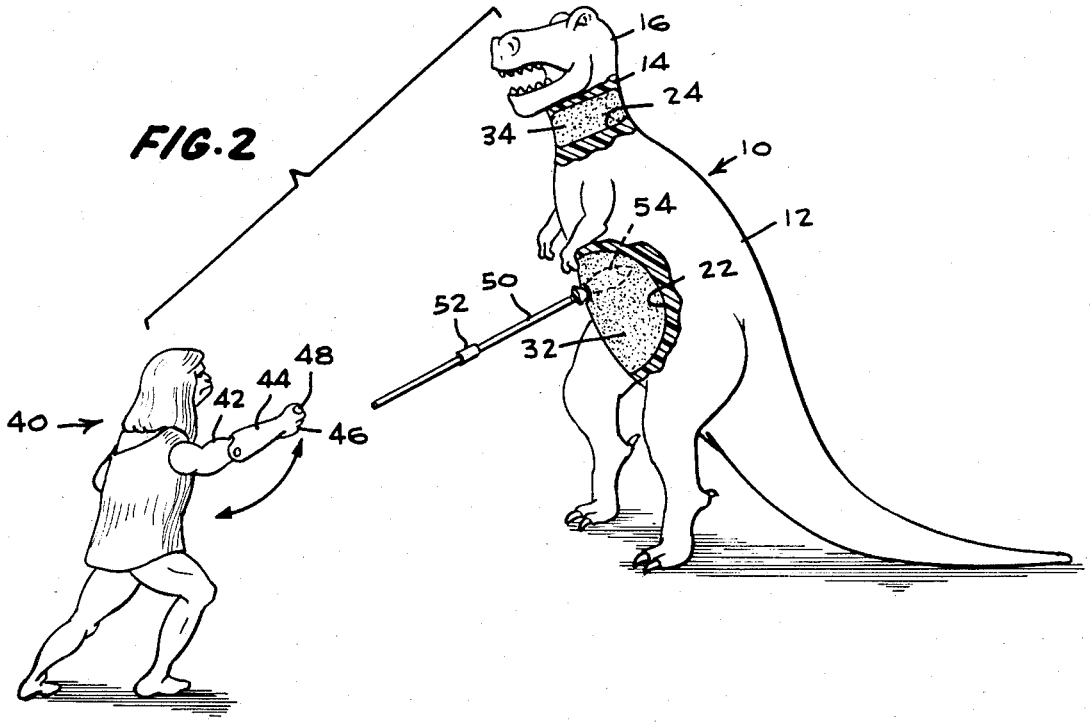
FIG. 2 is a perspective view similar to FIG. 1, with parts removed and in section, and the figures in different positions.

Referring now to FIG. 2, there is shown the target figure 10 with the vulnerable stomach region depression cavity 22 in the body 12 and the passage cavity 24 in the vulnerable neck region 14. In the cavity 22, there is the clay-like mass 32, and in the cavity 24 there is the clay-like mass 34. The spear 50 is shown with the point 54 thereof embedded in the clay-like mass 32 at the vulnerable stomach region of the dinosaur target figure 10. The hunter figure 10 has, in play, been advanced towards the dinosaur target figure 10, and has been manipulated so that the spear 50 has been thrust into the mass 32, after which the hunter figure 40 has been caused to be withdrawn; the spear remains in and is retained in its position by the mass 32, having slid out of the hand 46.

Figure 3:
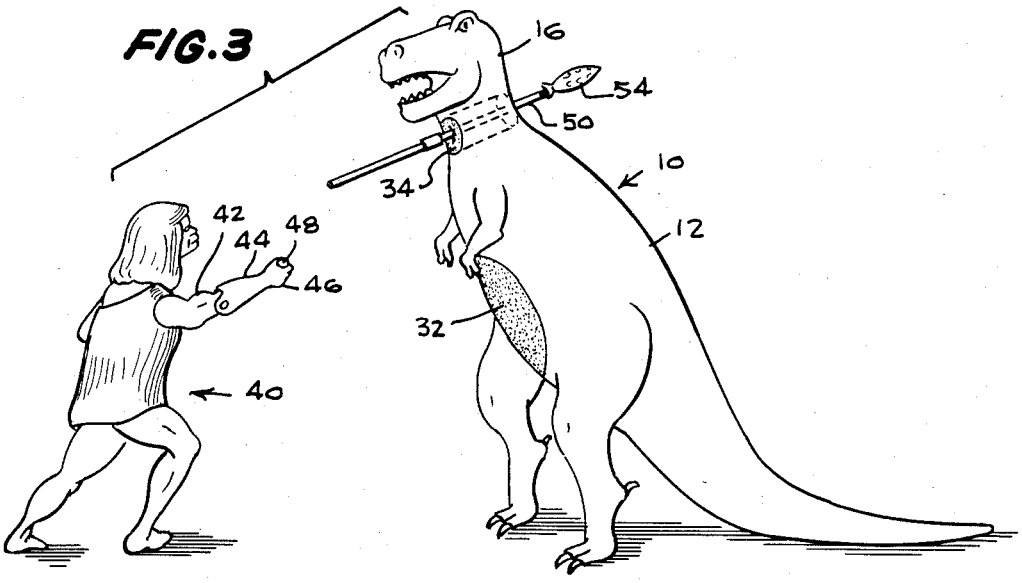
FIG. 3 is a perspective view similar to FIG. 1, showing the parts in another position thereof.

As shown in FIG. 3, the hunter figure 40 could also be manipulated to insert the spear 50 into and through the clay-like mass 34 in the vulnerable neck region. Thus, the spear 50 has been thrust into the clay-like mass 34 to such an extent that the point 54 has penetrated entirely through the mass, and is located in the region of the back of the figure 10. The spear 50 is held or retained in this position by the clay-like mass 34. The articulation of the hunter figure 40 is for illustrative purposes, and other articulations than those indicated could be provided. Further, while the hunter figure 40 has been shown as a human or humanlike individual, other forms of hunter figure could be provided. For example, the hunter figure could be of animal or animal-like form, and be provided with horn, fang, claw, etc. which will provide injury or damage to the adversary or hunted figure, and which natural weapon may or may not be disengaged from the one animal or animal-like figure and remain in the other figure.

Figure 4B:
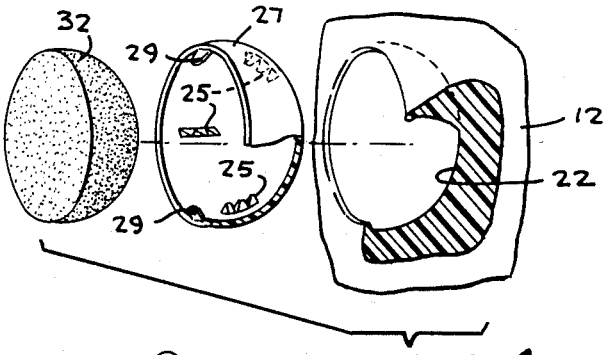
FIG. 4B is an exploded view, partly in section and in perspective, of an alternate arrangement for supporting clay-like material in a figure.
Figure 4:
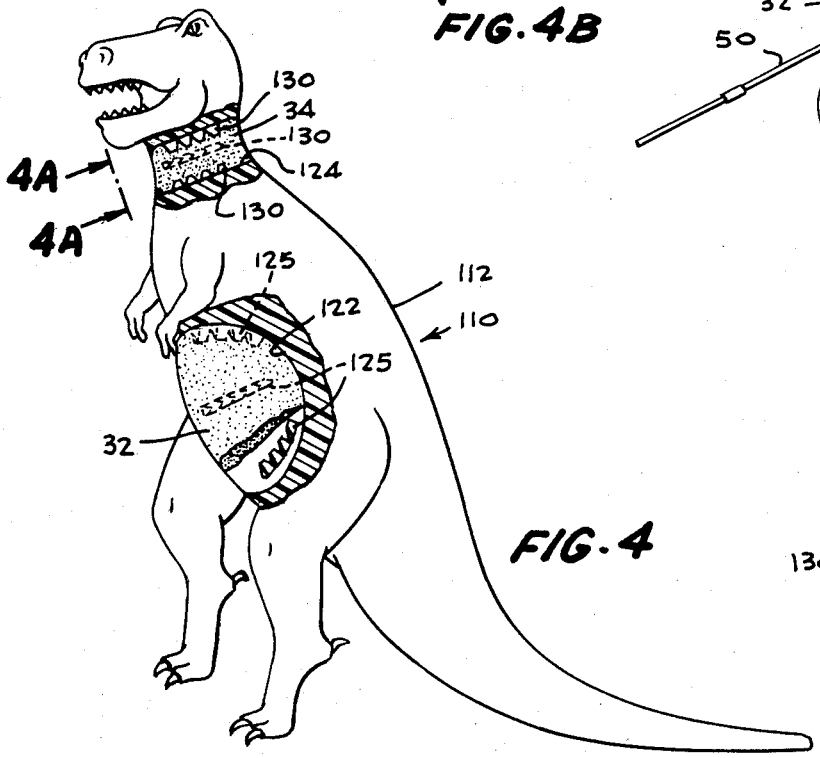
FIG. 4 is an elevational view of a toy figure in accordance with the present invention, and having protrusions for retaining clay-like material in cavities thereof.

In FIG. 4, a figure 110 is shown, generally in the form of a dinosaur, having a cavity 122 in the abdominal region, with a clay mass 32 therein. Extending into the cavity 122 are a plurality of protrusions 125. These extend into the clay-like mass 32 when it is in position, as shown, in the cavity 122, and assist in retaining the clay-like mass 32 in the cavity 122. For example, if the clay-like mass or substance 32 is left for a relatively long period of time, it may tend to shrink, to have dimensions which are less than the cavity 122, and in that event, the projections 125, which extend from the sides of cavity 122, will retain the clay-like mass 32 in place.

Figure 4A:
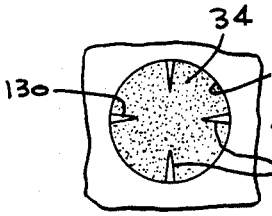
FIG. 4A is a view taken on the Line 4A—4A of FIG. 4.

In the neck region, there is a cavity passage 124 extending entirely through the vulnerable neck region, having therein clay-like mass 34. Projections 130 extend from the sides of the cavity passage 124. As shown in FIG. 4A, the cavity 124 extends through the body 112 of the figure 110, with the projections 130 extending from the wall of the cavity 124 inwardly. The projections 130 are flat, similar to a blade, and the flat surfaces 130A thereof are in planes which are generally parallel to the anticipated direction of thrust of a spear 50 (see FIGS. 1-3) or other similar weapon. In this way, there is the provision of protrusions 130 which will assist in retaining the clay-like mass 34 in the cavity 124, with minimum chance of being struck by the spear 50 or similar weapon.

The clay-like mass 32, 34 will have a tendency to surround the protrusions 125, 130, not only assisting in retaining the clay-like mass should it shrink, as may occur with a loss of moisture, but also would resist the removal of the clay-like mass from the cavity when the weapon is withdrawn. Thus, in a simulation of actual events, the weapons may be withdrawn, leaving the clay-like mass in place. As is apparent, even should a weapon, such as a spear, strike one or more of the projections, it will be deflected, so as to pass through the mass, rather than being stopped or obstructed by the projection.

An alternate construction for supporting the clay-like mass in the cavity is shown in FIG. 4B, wherein there is shown a portion of the body 12 of a figure having a cavity 22 which is of the kind which extends only partly through the body 12, although it is understood that a cavity which extends completely through the body 12 is also contemplated. At its opening which is at the surface of the body 12, the cavity 22 has an overhanging bead 23. As shown, the bead 23 extends completely around the opening, this being the preferred form. A container 27 is provided, having inwardly-directed projections 25 at spaced locations. The container 27 is of a flexible, preferably thin plastic material which may be distorted, and which will return to its original shape. It has a shape which substantially conforms to the shape of the cavity 22. The projections 25 are preferably in the form of rows of blade-like elements, with the thin edges directed towards the opening. Tabs 29 are provided at the opening of the container 27. A clay-like mass 32 is shown, having generally the configuration of the container 27 and cavity 22.

The clay-like mass 32 is assembled with the container 27, filling it and being held therein by the protrusions 25. One or more such filled containers 27 may be provided, and placed in a hermetically-sealed repository, or covered with material which will exclude air. When it is desired to place a filled container 27 in a cavity 22, it may be readily pushed into position in the cavity 22, being deflected in order to have its edge pass the bead 23, whereafter it will return to its original position, so that the bead 23 retains the container 27 in the cavity 22; the aforementioned projections 25 serve to retain the mass 32 within the container 27. When it is necessary to replace the clay-like mass 32, one or more of the tabs 29 are grasped by the fingers of the player, to deform the container 27 and enable it to be withdrawn, with as much of the clay-like mass 32 as remains, from the cavity 22, to be replaced by a fresh, filled container 27.

Figure 5:
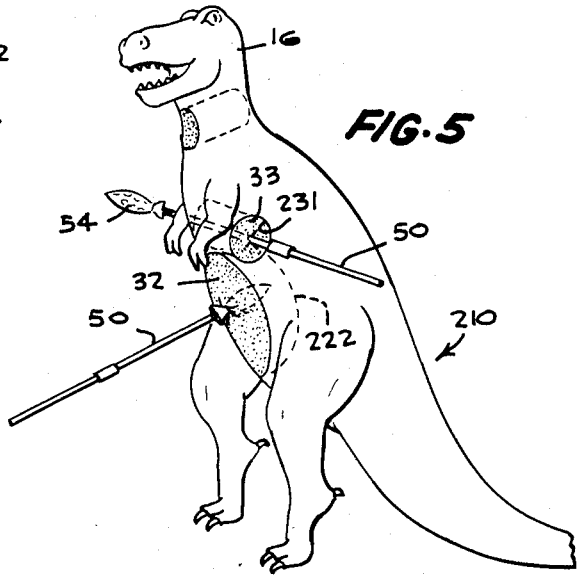
FIG. 5 is an elevational view of an alternate embodiment of a figure simulating a hunted animal in accordance with the present invention.

FIG. 5 discloses a figure 210 which is generally in the shape of a dinosaur, there being provided not only the abdominal cavity 222, with clay-like mass 32 therein, and which is formed as a depression which extends inwardly from the front surface of the figure 210, but there is also provided an additional cavity 231 which is of generally cylindrical configuration, having its axis extending laterally, thereby simulating another vulnerable area, which may be unprotected and have a vital organ, such as a heart, therein in the animal or creature being simulated. As in shown, the cavity 231 is provided with a clay-like mass 33, and a spear 50 has penetrated the mass 33, passing completely through that portion of the figure 210. An additional spear 50 is shown in the mass 32 in the cavity 222. In both cases, the spear is retained in position by the clay-like mass in the relevant cavity. The cavities 222 and 231 may intersect each other, so that there is an intermingling of the two clay-like masses 32 and 33.

It is within the scope of the present invention to provide various toy figures, which may simulate not only a hunter and hunted animal, but there may be provided toy figures which simulate combat. Such figures may take the form of similar or dissimilar animals, various combat objects, such as planes, ships, tanks, space craft, etc., and may take the form of two or more human or human-like combatants. By way of example, a simulated elephant and rhinoceros may be provided, using their tusk or horn, without retention of the tusk or horn by the clay-like body or mass of the opposing figure.

Figure 6:
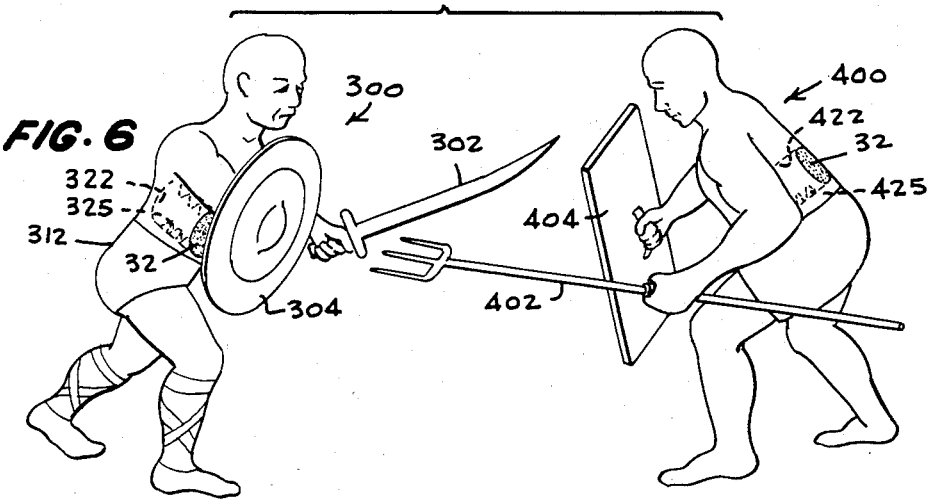
FIG. 6 is a view illustrating apparatus in the form of gladiators, illustrating the present invention.
Figure 7:
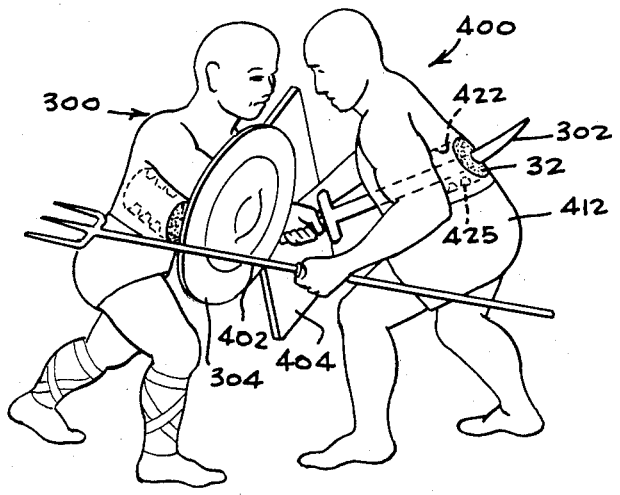
FIG. 7 is a view similar to FIG. 6, with the parts in an alternate position.
Figure 8:
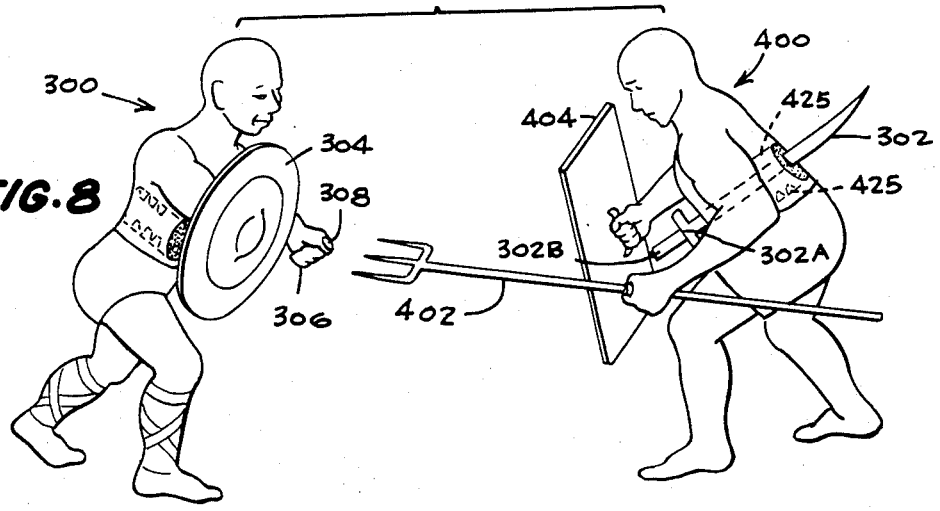
FIG. 8 is a view of the figures of FIG. 6, with the elements in still another position.

As an example of human or human-like combatants, reference is made to FIGS. 6–8, wherein there is shown a first figure 300 simulating a gladiator, having a sword 302 and a shield 304. A cavity 322 extends through the body 312 of the gladiator figure 300, in the region of the abdomen, and is filled with a clay-like mass 32. A second gladiator figure 400 is provided with a trident spear 402 and a shield 404, and has an abdominal cavity 422 in which is a clay-like mass 32. The gladiator figures 300 and 400 are of impenetrable material, such as plastic or cast metal, and may be manipulated to simulate combat. Both are provided with protrusions 325 and 425 in the cavities 322 and 422, respectively, to retain the clay-like mass 32 in place; they may also utilize a container generally as shown in FIG. 4B, modified to conform to the cavities. The positioning of the shields 304 and 404 relative to the cavities 322 and 422, respectively, is such that there is a small opening through which the weapon of the opponent must pass, in order both to avoid the shield of the opponent, and still engage the clay-like mass 32 of the opponent. FIG. 7 shows the gladiator figures 300 and 400 in an alternate position, in which the gladiator figure 300 has been successful in having his simulated sword 302 penetrate through the body 412 of his opponent gladiator figure 400, the sword 302 having entirely penetrated through the cavity 422 and the mass 32 therein. The simulated gladiator figure 400 has been unsuccessful in attempting to injure his opponent gladiator figure 300, but has succumbed to the maneuvering of the gladiator figure 300 which has thereby been successful in having his sword 302 pass by the shield 404.

In FIG. 8, the gladiator figure 300 is shown as having withdrawn from the vicinity of the gladiator figure 400, leaving the simulated sword 302 in the gladiator figure 400. The sword 302 will be seen to have a hilt 302A and a handle 302B, which latter has been withdrawn from an opening 308 formed in the hand 306 of the gladiator figure 300.

While there has been shown in FIGS. 1–3 and 6–8 only two figures, simulating a hunter and a hunted, or two combatants, respectively, it will be understood that the present invention contemplates the provision of a substantial additional number of figures, for play by two or more children. Thus, multiple figures may be used to provide for simulation of animals hunting in groups, humans or human-like creatures hunting one or more animal or animal-like figures, as well as the simulation of combat by utilizing a greater number of combatant-simulating figures. While gladiators have specifically been shown in the illustrative drawings, the combatant figures may be in the form of soldiers, cowboys and Indians, as well as various planes, tanks, ships and space craft. Each figure will be provided with at least one cavity, whether in the form of a depression or a through passage, which is filled or substantially filled with clay-like material as hereinabove described. That is, the clay-like material may be provided either directly into the cavity or cavities of the figure, or may be provided in a container which, with the clay-like material, may be inserted into a cavity which extends partly or completely through the toy figure. The weapon may be a hand-held weapon, such as a sword, spear, trident, etc., or a missile which may be simulated as having been thrown or propelled, or a natural weapon such as a horn, tusk, fang, claw, etc. The figures may include, as illustrated, not only a cavity, but also a weapon of one type or another. Further, singular or plural cavities may be provided in each of the figures, and means may be provided for retaining the clay-like material in the cavity or cavities in the figure.

It will be obvious to one skilled in the art that various changes may be made without departure from the spirit of the invention, and therefore the invention is not limited to that shown in the drawings and described in the specification, but only as indicated in the appended claims.

I claim:

1. An amusement device for simulating a hunted animal target figure comprising a body of a relatively hard material having the physical characteristics and appearance of an animal, said body having at least one cavity extending to the surface of the body, and clay-like material in said cavity, and an additional figure having in combination therewith a simulated weapon.

2. The amusement device of claim 1, wherein said additional figure is a human-like hunter figure, and said simulated weapon is a penetrating weapon.

3. The combination of claim 2, wherein said simulated weapon is a spear.

4. The combination of claim 1, said hunter figure comprising means for releasably holding said simulated weapon.

5. The combination of claim 1, said hunter figure being of simulated human form and having a hand with an opening therein, said simulated penetrating weapon being rod-like and sized to extend through said opening.

6. The combination of claim 5 and further comprising means for holding said simulated weapon in said opening.

7. The combination of claim 6, said means comprising an enlargement on said simulated weapon.

8. The amusement device of claim 1, and means in said cavity for retaining said clay-like material.

9. The amusement device of claim 8, said means comprising at least one protrusion extending into said cavity.

10. The amusement device of claim 9, said protrusion being blade-like, and having wide faces in planes substantially parallel to the direction of thrust of a penetrating weapon.

11. A toy target comprising a target body, a cavity in said target body extending to a surface of said body, a mass in said cavity, said target body being of a material substantially impenetrable by a simulated penetrating weapon and said mass being of a clay-like material capable of being penetrated by said simulated weapon, and in combination therewith a toy figure simulating a hunter, said hunter-simulating figure having a simulated penetrating weapon.

12. The toy target of claim 11, said target body simulating an animal.

13. The toy target of claim 11, and means in said cavity for retaining said clay-like material.

14. The toy target of claim 13, said means comprising at least one protrusion extending into said cavity.

15. The toy target of claim 14, said protrusion being blade-like, and having wide faces in planes substantially parallel to the direction of thrust of a penetrating weapon.

16. A toy target comprising a target body, a cavity in said target body extending to a surface of said body, a mass in said cavity, said target body being of a material substantially impenetrable by a simulated penetrating weapon and said mass being of a clay-like material capable of being penetrated by said simulated weapon, means on said body for releasably supporting a simulated penetrating weapon, and in combination therewith a second such toy target.

17. The toy targets of claim 16, wherein each of said toy targets comprises a shield partly protecting said cavity.

18. The toy targets of claim 17, said targets simulating human combatants.

19. A toy target comprising a target body, a cavity in said target body extending to a surface of said body, a mass in said cavity, said target body being of a material substantially impenetrable by a simulated penetrating weapon and said mass being of a clay-like material capable of being penetrated by said simulated weapon, a container in said cavity having an opening at the surface of said body, said clay-like material in said container.

20. The toy target of claim 19, and means for retaining said container in said cavity.

21. The toy target of claim 20, said retaining means comprising overhanging means on said body at the entrance of said cavity.

22. The toy target of claim 19, said container being of flexible material and substantially conforming to the shape of said cavity.

23. The toy target of claim 22, said container having means for retaining said material therein.

24. The toy target of claim 22, said container having at least one tab adjacent said opening.

* * * * *